US006336340B1

(12) United States Patent
Laby

(10) Patent No.: US 6,336,340 B1
(45) Date of Patent: Jan. 8, 2002

(54) STORAGE CONTAINER FOR STORAGE OF TEMPERATURE SENSITIVE MATERIALS DURING TRANSPORT

(76) Inventor: Ralph Henry Laby, 175 Ormond Road, Longwarry VIC 3816 (AU)

( * ) Notice: Subject to any disclaimer, the term of this patent is extended or adjusted under 35 U.S.C. 154(b) by 0 days.

(21) Appl. No.: 09/763,975

(22) PCT Filed: Aug. 31, 1999

(86) PCT No.: PCT/AU99/00700

§ 371 Date: Feb. 28, 2001

§ 102(e) Date: Feb. 28, 2001

(87) PCT Pub. No.: WO00/12409

PCT Pub. Date: Mar. 9, 2000

(30) Foreign Application Priority Data

Aug. 31, 1998 (AU) ..... PP5603

(51) Int. Cl.[7] ..... F25D 3/08
(52) U.S. Cl. ..... 62/371; 62/457.2; 62/530
(58) Field of Search ..... 62/371, 457.2, 62/530, 372, 529, 60, 457.1; 206/588; 126/263.03

(56) References Cited

U.S. PATENT DOCUMENTS 4,377,075 A 3/1983 Russo
4,723,974 A * 2/1988 Ammerman ..... 62/371 X
4,738,364 A 4/1988 Yeager
6,223,551 B1 * 5/2001 Mitchell ..... 62/371

FOREIGN PATENT DOCUMENTS

WO WO 91/02458 3/1991

* cited by examiner

*Primary Examiner*—Henry Bennett
*Assistant Examiner*—Chen-Wen Jiang

(57) ABSTRACT

A storage container for storing temperature sensitive materials, particularly materials that are sensitive to temperatures below zero degrees Centigrade, includes a two layer structure. The outer layer of the container is made of a material including a volume of coolant capable of being frozen to temperatures substantially below zero degrees Centigrade, such as −26° C. An inner layer of the container includes a volume of water that is selected relative to the volume coolant in the outer layer such that, when the two layers are combined, material held within the inner layer is maintained above 0° C. Both inner and outer layers of the container may be structured, for example, as envelope products.

15 Claims, 8 Drawing Sheets

STORAGE CONTAINER FOR STORAGE OF TEMPERATURE SENSITIVE MATERIALS DURING TRANSPORT

FIELD OF THE INVENTION

This invention relates to a cool keeping transportable arrangement and also to a method to assist in keeping cool materials for transport purposes.

The problem to which this invention is addressed relates to the difficulties associated with keeping materials, typically biological materials, within a selected cool range of temperatures during transport.

BACKGROUND OF THE INVENTION

Pharmaceutical and similar companies have need to transport quantities of biological materials including blood products, vaccines and some prescription lines that must be kept cool in transport but which cannot be allowed to freeze. Such materials are sometimes accompanied by an instruction to store at a low temperature, typically four degrees Centigrade. Generally, these products are based on water which therefore contains some dissolved materials (e.g. normal saline, 0.9% sodium chloride). Such materials therefore have a freezing point a little below zero degrees Centigrade.

Transport of retail quantities of these products has increasingly relied on insulated containers containing a coolant block to maintain temperatures in the range 0 to 8 degrees Centigrade for the period of transport. Arbitrary test schemes have been established by large companies and health authorities to ensure reliability of the coolant systems to deliver the products in good condition. The existing coolant systems rely on the establishment of a steadystate temperature within the required range whereby the rate at which heat is absorbed by the coolant equals the rate at which heat enters the cold area via the insulation. To prevent freezing of the product at low ambient temperatures, the coolants are frozen at a relatively high temperature, typically minus six degrees Centigrade, or are allowed to stand for a time above zero degrees Centigrade prior to use. These procedures limit the useful life of the coolant, and provide no guarantee that the products will not freeze.

It is preferable that standard deep freeze equipment can be utilized to freeze and store coolant systems and it is an object of the present invention to provide a package which can thus utilize standard deep freeze equipment and yet maintain the temperature of stored product above freezing.

SUMMARY OF THE INVENTION

There is proposed in accordance with the invention a storage container for storage of temperature sensitive materials during transport, the storage container being characterized in that it includes:

- an outer layer or container of coolant material able to be frozen to temperatures substantially below the freezing point of water,
- a removable inner separating layer configured to separate the material to be stored and transported from the outer layer, or container, the inner separating layer containing a volume of water therein, the volume of water being determined in proportion to the amount and temperature of the coolant material in the outer layer Preferably, the relative proportions of water in the inner separating layer and the outer layer are selected such that during typical transport times the temperature of material held in the container is maintained within the temperature range 0–8° C.

Using the outer layer and the separating layer as described the container or package of the present invention takes advantage of the physical properties of ice and water mixtures.

A mixture of ice and water at atmospheric pressure defines zero degrees. At this temperature there is equilibrium between ice and water. Attempts to heat the mixture does not alter the temperature but simply causes ice to melt at a rate of one gram of ice melting per 334 joules of heat energy absorbed, that is the heat of fusion of ice. When all ice has melted, the water temperature can then rise. The opposite is true on cooling down ice water mixture. Water at zero degrees Centigrade will form ice on releasing heat. This process can be driven by having material present at a lower temperature which can absorb the heat and drive the process. Thus, in the present case the outer layer of coolant material can be frozen and stored using standard deep freeze equipment. A separating layer can be maintained in a cold space such as a refrigerator or cold room at a temperature above zero degrees Centigrade in a non-frozen state.

When it is necessary to transport temperature sensitive material the outer layer and separating layer can be combined so that the separating layer is in contact with the material and holds the temperature of the material above zero degrees Centigrade.

The quantity of water necessary in the separating product can be calculated from a consideration of the temperature of the outer layer bearing in mind the specific heat of ice at that temperature and also the latent heat of fusion of ice.

Typically the outer layer would be deep frozen to −30 degrees Centigrade in commercially available deep freeze units. The specific heat of ice at −30 degrees Centigrade is approximately 1.88 joules per gram per degree Centigrade. The specific heat of ice at zero degree Centigrade is 2.1 joules per gram per degree Centigrade. The outer layer may be, for example, a vaccine box.

Thus, 100 grams of ice frozen to −30 Centigrade can absorb approximately 5971 joules of heat from water at 0 degrees Centigrade.

In turn, to form ice at 0 degrees Centigrade from water at 0 degrees Centigrade requires 334 joules per gram. Accordingly 5971/334=17.9 grams of ice could be produced. Therefore, provided the separating layer contains at least 18 grams of water per 100 grams of deep frozen ice product, the separating layer can prevent freezing of the temperature sensitive products it contains during normal transport times and ambient temperatures, .

In preference, the separating layer comprises a liquid contained within a holding package. In some forms of the invention, the water in the inner separating layer may be in gelled or other supported forms.

In preference, the separating layer comprises water held within one or more bags or pockets and such that the shape of such a bag or pocket is either appropriate that the material can be placed so as to be surrounded by the liquid held in the bag or bags or that the bag or bags can be rolled or folded appropriately to surround any smaller biological material.

One of the problems with an arrangement such as this is that if the separating material is not consistently located so as to ensure that it will always provide a separation between a frozen material and the sample, then there is a possibility that direct contact of the frozen material, perhaps through only thin sheets of plastics separation, can freeze some part or all of the sample.

In preference then, there is a continuous bag to hold the separating layer and within the bag, a spreader which will retain the ice water mixture therethrough and keep this substantially spread throughout the full area of the pocket or pockets.

It is appreciated that the quantity of separating layer has to be sufficient so that, given a time over which coolness within a selected temperature range is to be achieved, that such materials both in terms of quantities and in terms of initial temperatures and in terms of ambient temperature situations, will ensure an adequate result.

In preference, the separating layer is kept at an initial stage in a storage means so that the temperature is at a temperature that is appropriate for the longer storage of the biological material so that the two parts can be kept in a cold storage prior to transport together.

In preference then, if there is a small sample of biological material to be kept within the temperature from 0 degree Centigrade to 6 degrees Centigrade, both a surrounding package of water and the sample would be kept within the refrigerator at a temperature of say 5 degrees Centigrade.

When the biological material is called for to be transported to a different place and needs to be kept over a sustained period within the temperature range, the combination of separating layer with the biological material embedded in this, is inserted in a cool keeping container where now, a frozen material held within an insulating outer, can be at a substantially lower temperature than otherwise would hitherto have been available.

In a typical example which will be described in the embodiments, such outer frozen materials can now be started at a temperature of say minus 22 degrees Centigrade knowing that the biological material will be kept from any freezing temperature by the intervening material containing water surrounding the biological material.

In experiments conducted thus far, very substantial extensions of time have been achieved with relatively economic and efficient packaging using these concepts.

BRIEF DESCRIPTION OF THE DRAWINGS

For a better understanding of this invention it will now be described with relation to embodiments in which.

DESCRIPTION OF PREFERRED EMBODIMENT

Referring in detail to the drawings there is shown, in particular, the construction of a container for storage during transport of temperature sensitive materials including a separating layer material arranged so that a sample will not have the potential to be directly communicating with frozen materials and thereby become frozen.

Figure 1:
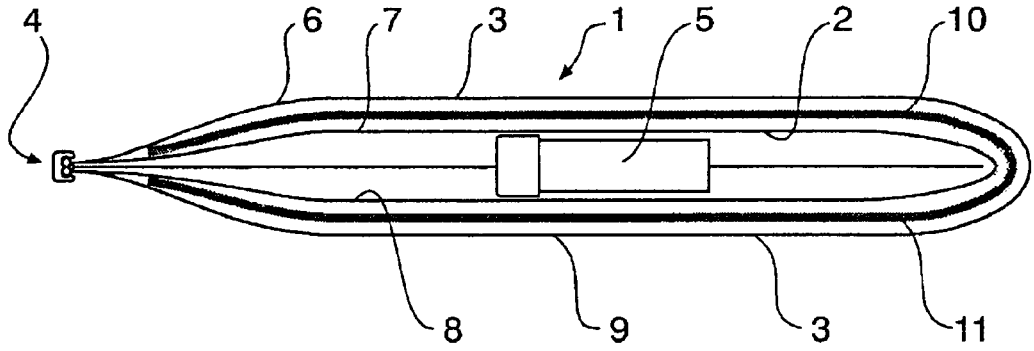
FIG. 1 is a cross-sectional view of a separating layer of a container for storage of temperature sensitive materials during transport in accordance with the present invention.
Figure 2:
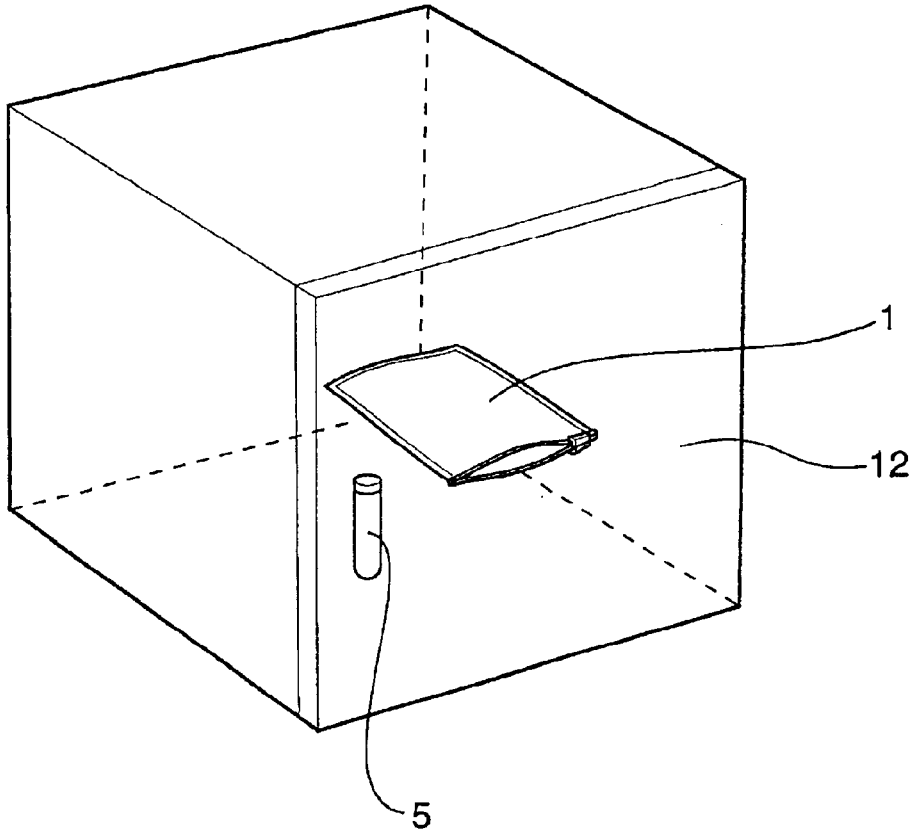
FIG. 2 illustrates a refrigerated container holding as separate components at the same temperature, the separate envelope, and the biological material.
Figure 5:
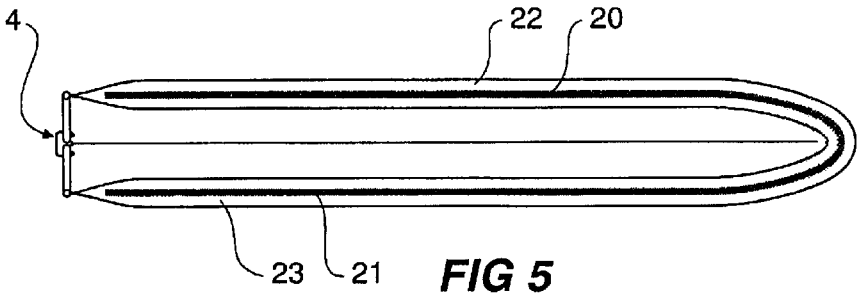
FIG. 5 is a further illustration in cross-section of the inner separating layer shown in FIG. 1 showing a displacement medium within the pockets forming the separating layer.

Illustrated in FIGS. 1 and 5 is an inner envelope 1 having an inner side 2 and an outer side 3 each of which are defined by being formed from pliable sheet plastics material. The envelope has an opening 4 and, as will be described herein serves as an inner layer for a container in accordance with the invention. The envelope 1 surrounds any material held therein. In the example shown the envelope 1 has no closure mechanism, although any convenient closure means can be adopted if wished. Convenient closure means include flaps, whether resealable or unsealed, zip fastenings or hook and loop fastenings.

Within the pockets thus formed by inner and outer sheets 2, and 3, for instance, at 6 and 7 in the one case and 8 and 9 in the other there is trapped a liquid gel which however is held generally within a fibrous matting 10 in the one case and 11 in the other. The gel may be, for instance a polyethylene glycol water mixture, or a mixture of cross-linked sodium polyacrylate superabsorbent and water.

This fibrous matting which can be in the form of compacted cellulose or other stable long lasting but compact resistant material has for its purpose to ensure that there will always be an adequate gel thickness between a vial 5 during transport and especially materials within the vial 5 and any external surface from the envelope 1.

It is to be realised that such a shape is generally therefore of continuous thickness across one face so that there will not, for instance, be a seam arranged so that the vial will accidentally have a part line alongside the seam and therefore be much closer in contact with frozen gel outside of this separating material.

The structure of the envelope 1 is also arranged so that this is compatible with the shape of the vial 5 so that even in extreme circumstances, for instance if the vial is pressed into an edge or a corner, there will always be resistance to and sufficient separation by reason of the shape of the edges which are welded together and the quantity of material held within the fibrous material.

If the envelope 1 is then kept at a temperature approximating that at which the biological materials are to be kept, then it is found that there can be very significant advantages achieved in terms of the time that biological materials can be kept at a constant temperature or at least within an acceptable range of cooler temperatures without having been frozen to achieve this.

A first step in this process then is to keep the biological material in the vial 5 in a refrigerator such as at 12 where the envelope 1 is also kept.

Conventionally then, in commercial operations, all of the vials 5 can be kept together either separate from or within the envelopes 1 ready for transport as necessary.

Figure 3:
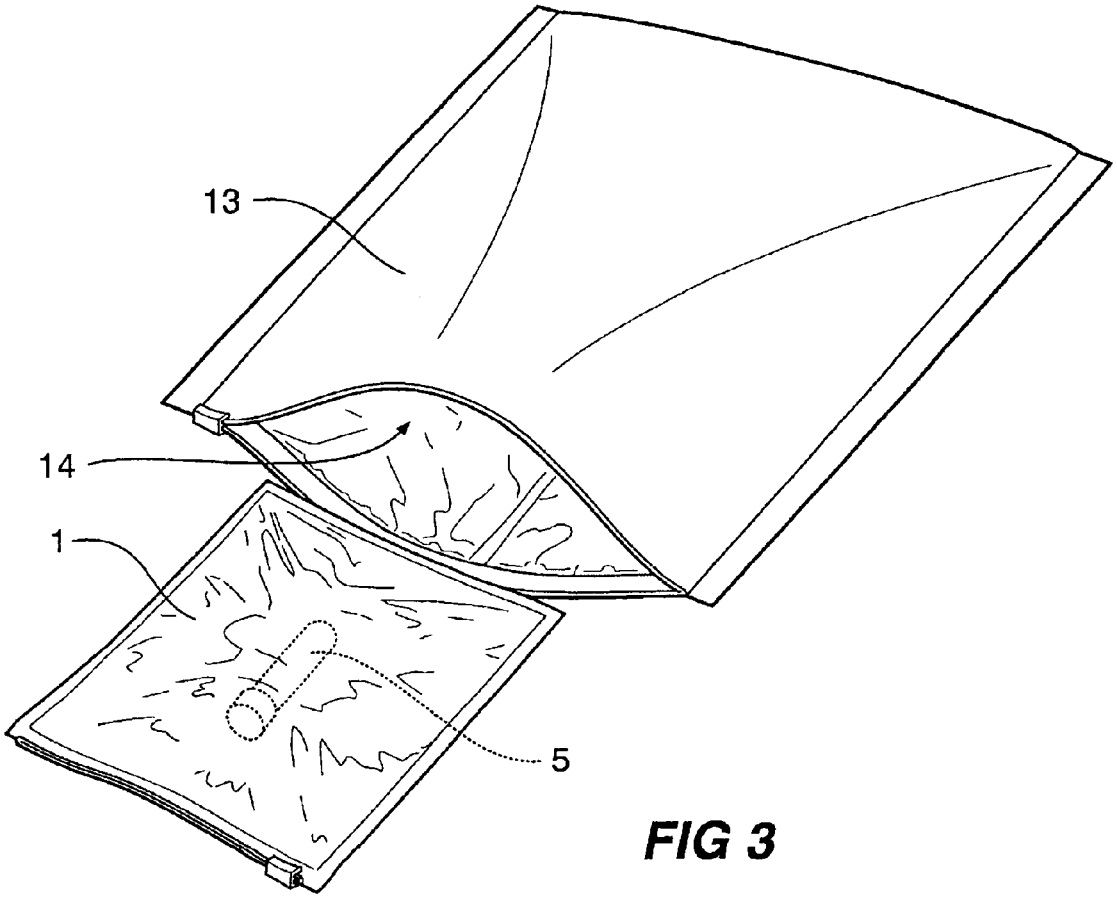
FIG. 3 illustrates a container for storage of temperature sensitive materials during transport.
Figure 4:
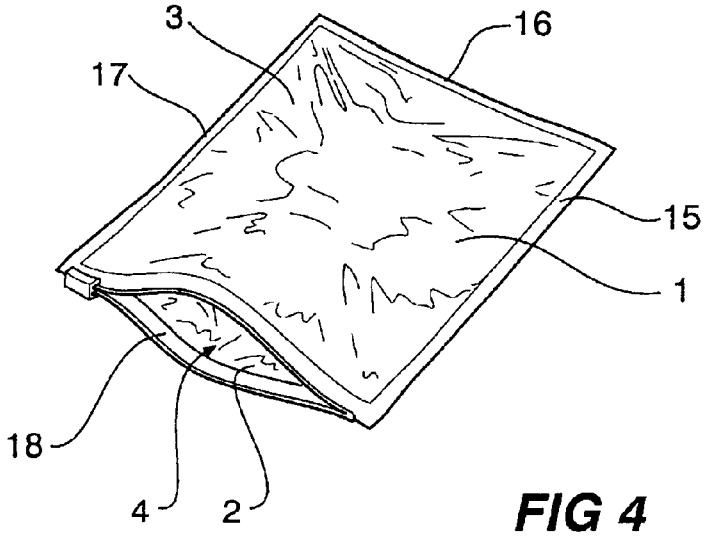
FIG. 4 is a perspective view of a separating layer as shown in claim 1.

When it comes time to transport, a cold keeping envelope 13, serving as an outer layer of the container, as shown in FIG. 3 and 4 is then opened and the envelope 1 together with the vial 5 in there is inserted therein.

The cold keeping envelope 13 is of a type that has been previously described in previous patents by others in connection with providing both insulation on an outer side and frozen gel type capsules inside such as at 14 and so that these are able to be bent into a shape even when frozen so as to surround any material that might be inserted therein.

The problem hitherto however with the cold keeping envelope such as at 13 is that if this is kept frozen at a very cold temperature, then, while the amount of additional time that it will keep cold increases, so too does the possibility that any biological material within it, will be frozen.

There is therefore a trade off and in practice, if the temperature of a cool keeping envelope 13 is kept much below −13 degrees Centigrade, then there is a high degree of risk without the heat absorbing envelope, for freezing of the biological material to occur.

It has been previously emphasised that this freezing can occur for only a short time and yet this will spoil the biological effect of many materials and, in some cases, for instance, where a vaccine might be involved, it could destroy the effectiveness of this and therefore could potentially be fatal to people who rely upon its effectiveness.

The significant advantage of having therefore an envelope in the manner described, is that we can now reduce the temperature of the cold keeping envelope 13 significantly and typically down to −22 degrees Centigrade in one case while being confident that the envelope will adequately protect against momentary freezing of an internal material and yet will then allow for a reasonable temperature to be kept for the biological material over a longer period than has hitherto been possible with economic and effective apparatus.

An enlarged perspective view of the heat absorbing envelope 1 is shown in FIG. 4 with a dotted outline showing in one case the position of the fibrous material and showing more specifically the edge seams which are referred to specifically at 15, 16 and 17 which keeps the upper and lower layers in a wedge shape at the edges which, of course, inhibits access to the vial 5.

In a more schematic view of the arrangement within the envelope 1, FIG. 5 shows then a thinner fibrous material at 20 in the upper layer and 21 in the lower layer with liquid 22 and 23 chosen to be of a volume and appropriately dispersed for the purposes stated.

The relative thickness of this layer of material at 20 or 21 can be chosen but its purpose is to ensure that anything within the envelope shape will not push aside the liquid at a pressure point sufficient to get direct contact, that is plastic to plastic surface through the gel to an outside area that could possibly freeze therefore the inner materials.

Figure 6:
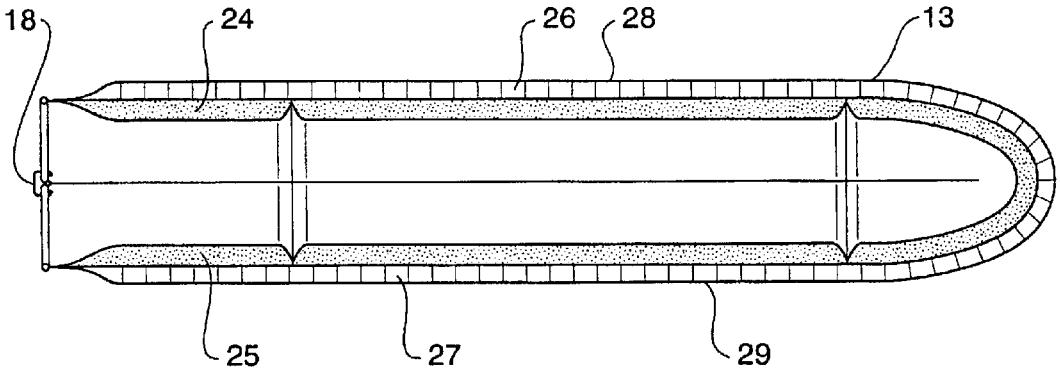
FIG. 6 is an envelope which is to be the outer layer envelope with pockets of gel to be frozen and into which an inner layer envelope in accordance with the invention is to be inserted.

FIG. 6 is a cross-sectional view of the cold keeping envelope 13 simply showing one illustration of a construction of this in which there are gel pockets at 24 on one side and 25 on the other and these are held insulated from an outer side by bubble pack at 26 and 27, and at least one of the edges such as at 28 and at 29 being comprised so that there is insulation protection of the inner frozen gel materials by both contained air pockets in the bubble pack material and radiant heat by reason of the reflective character of the aluminium foil. The cold keeping envelope 13 has a zip type closure 18 at one end, although alternative closure means, for example, hook and loop fastening could be used.

The invention as such does not rely upon the construction of the outer cold keeping envelope 13 other than in its use with respect to the separating material in the form of the envelope 1 in the way described.

Figure 7:
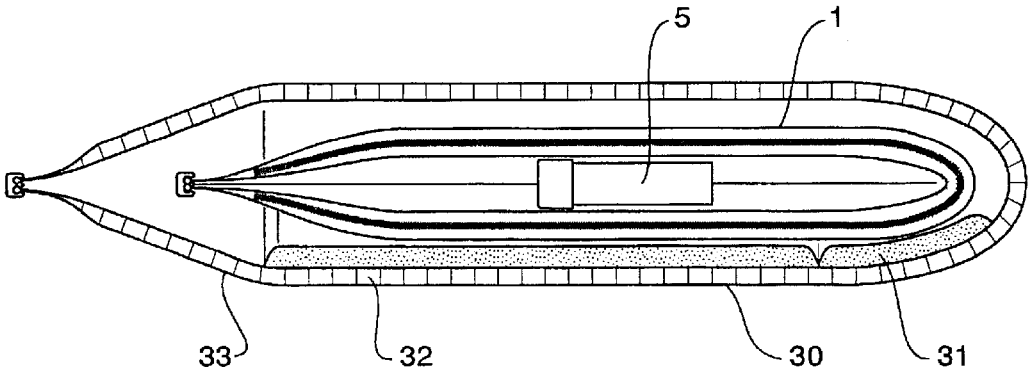
FIG. 7 is a cross-sectional view of a combination of an outer envelope with double insulation and reflective surfaces and including on one side only frozen cells of gel, and within this, an envelope as in either of FIGS. 1 or 5 and within this again, a vial holding appropriate sensitive materials for transport.

In FIG. 6, there is freezing gel cells on both sides of the cold keeping envelope 13 but in FIG. 7 there is a further total combination shown in which the cold keeping envelope 30 includes frozen gel cells at 31 on one side only and there is then the further insulating bubble pack material 32 and a reflective surface at 33 of aluminium foil.

The heat absorbing envelope 1 is now within this and there is again the vial 5 with appropriate materials therein which are therefore able to be held this longer period for cool keeping purposes.

The efficacy of the container of the present invention is shown with reference to FIGS. 9–12. In each case in FIGS. 9–12 the x-axis indicates time in minutes from the commencement of the test, and the y-axis indicates temperature in degrees centigrade.

Figure 8:
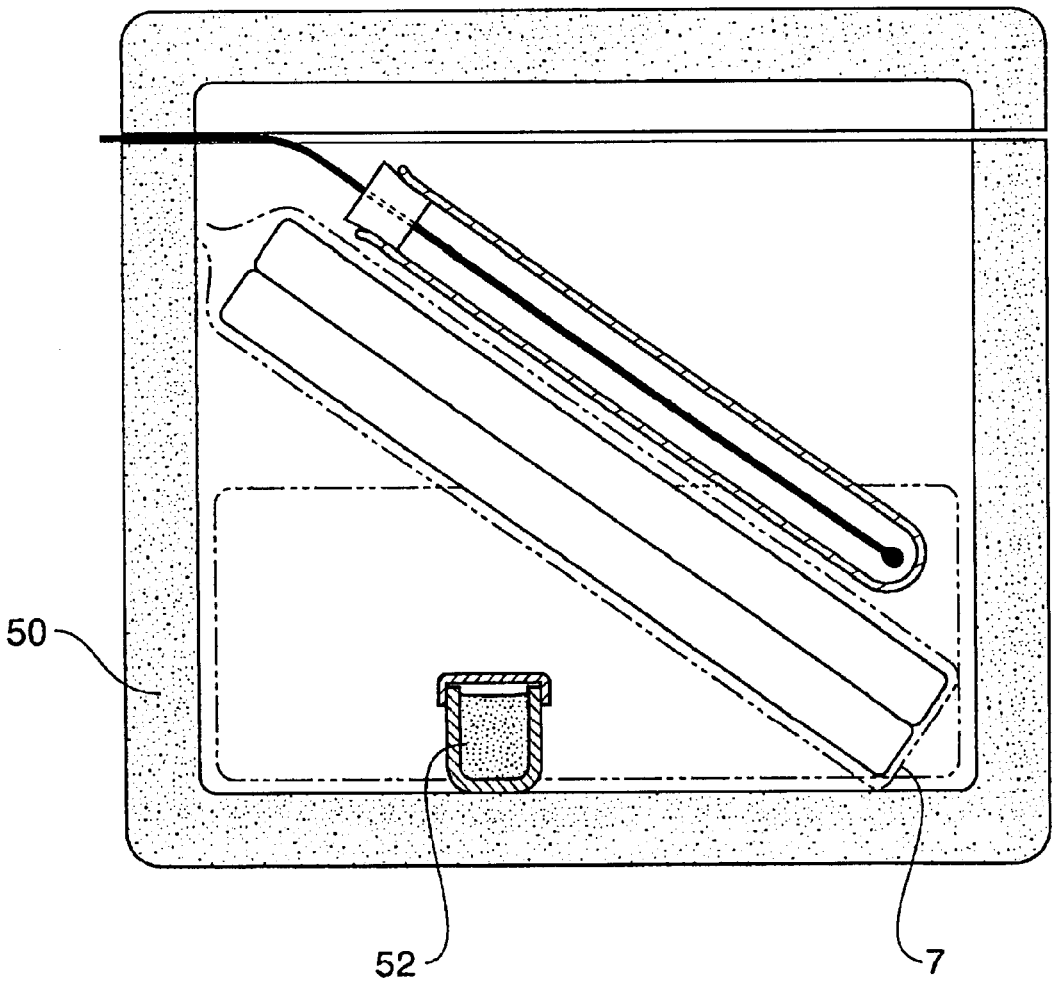
FIG. 8 is a cross-sectional view of a test bed illustrating the way in which relative temperatures have been measured in accord with temperature versus time readings referred to in FIGS. 9–12.

An experimental assembly is as shown in FIG. 8

Figure 9:
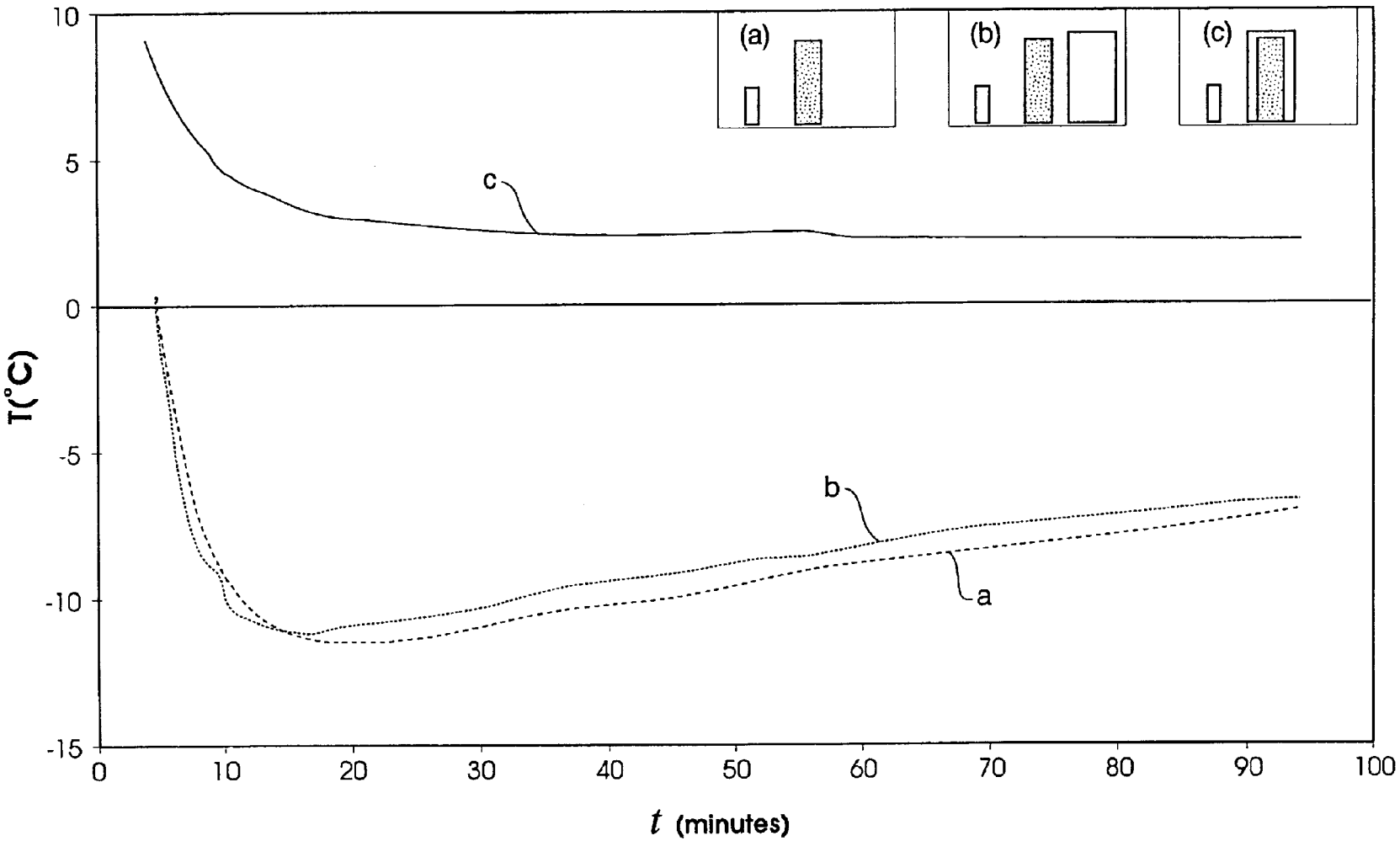
FIG. 9 illustrates a comparison of temperature of a sample of water in three different situations.

FIG. 9 illustrates, somewhat schematically, the results of testing occurring in three possible situations for cooling material.

In each case 920 grams of ice were stored in a five litre expanded polystyrene box 50. The initial temperature of the ice was −26 degree Centigrade. A small container 52 in the box holds a sample of water (50 ml) representative of biological material. The air temperature of the box was measured over time in three different conditions. These are represented graphically in FIG. 9 and are:

(c) The ice is contained within an envelope 1 and therefore separated from the material to be cooled;

(b) The ice is within the box and an envelope 1 is beside the ice; and (a) The sample is held in the box with the ice and no envelope is present.

As can be seen from the results in FIG. 9 by maintaining the ice within the envelope, situation (c) the temperature of the surrounding box does not fall below zero. Thus, the water mixture in the walls of the envelope are cooled by the ice but always at a temperature at which an ice water mixture will be present, namely above zero degrees Centigrade.

Figure 10:
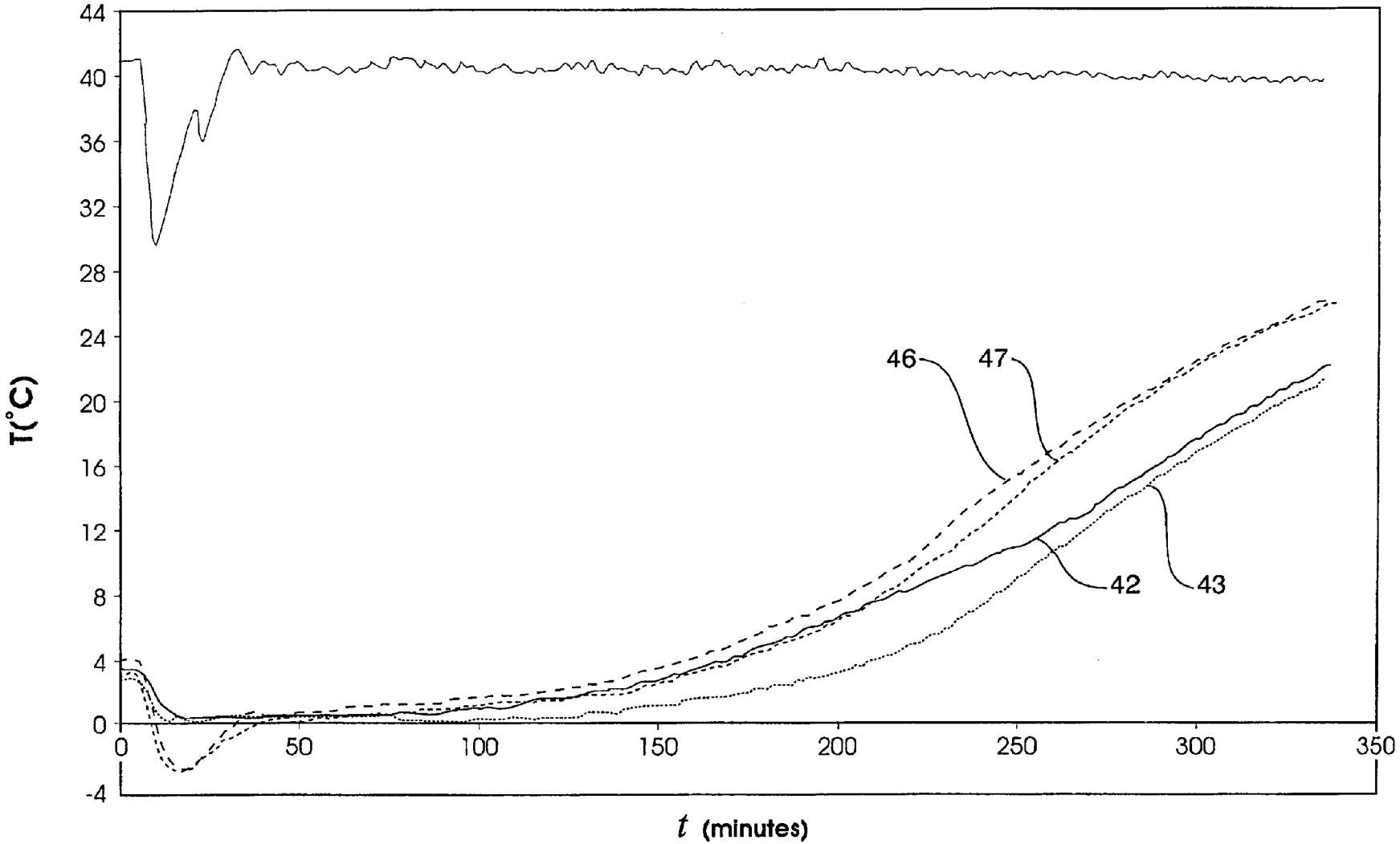
FIG. 10 is a temperature versus time readout illustrating the invention in use.

By contrast figures (a) and (b) show that the temperature of the box falls significantly below zero when the ice is not held in the envelope. FIG. 10 illustrates the use of a container in accordance with the invention at an ambient temperature of 40° C approximately.

Two 0.5 ml samples were kept in a container in the form of a cold keeping envelope 13. In this example the cold keeping envelope and the inner separating envelope 1 were each 400 g in weight.

In the two cases then shown at 42 and 43 in FIG. 10 it is shown that these have a temperature shown at 44 and 45 which dip below zero degrees Centigrade and therefore are in the freezing range and they sustain this for a period of some 30 minutes.

On the other hand, if the inner separating layer as shown at 1 in the various embodiments is used, we then have the example as shown in 46 in the one case and 47 in the other that these temperatures then hold just above freezing but in the safe range above this and will generally hold for something in excess of 200 minutes in external ambient conditions of about 40 degrees Centigrade.

Figure 11:
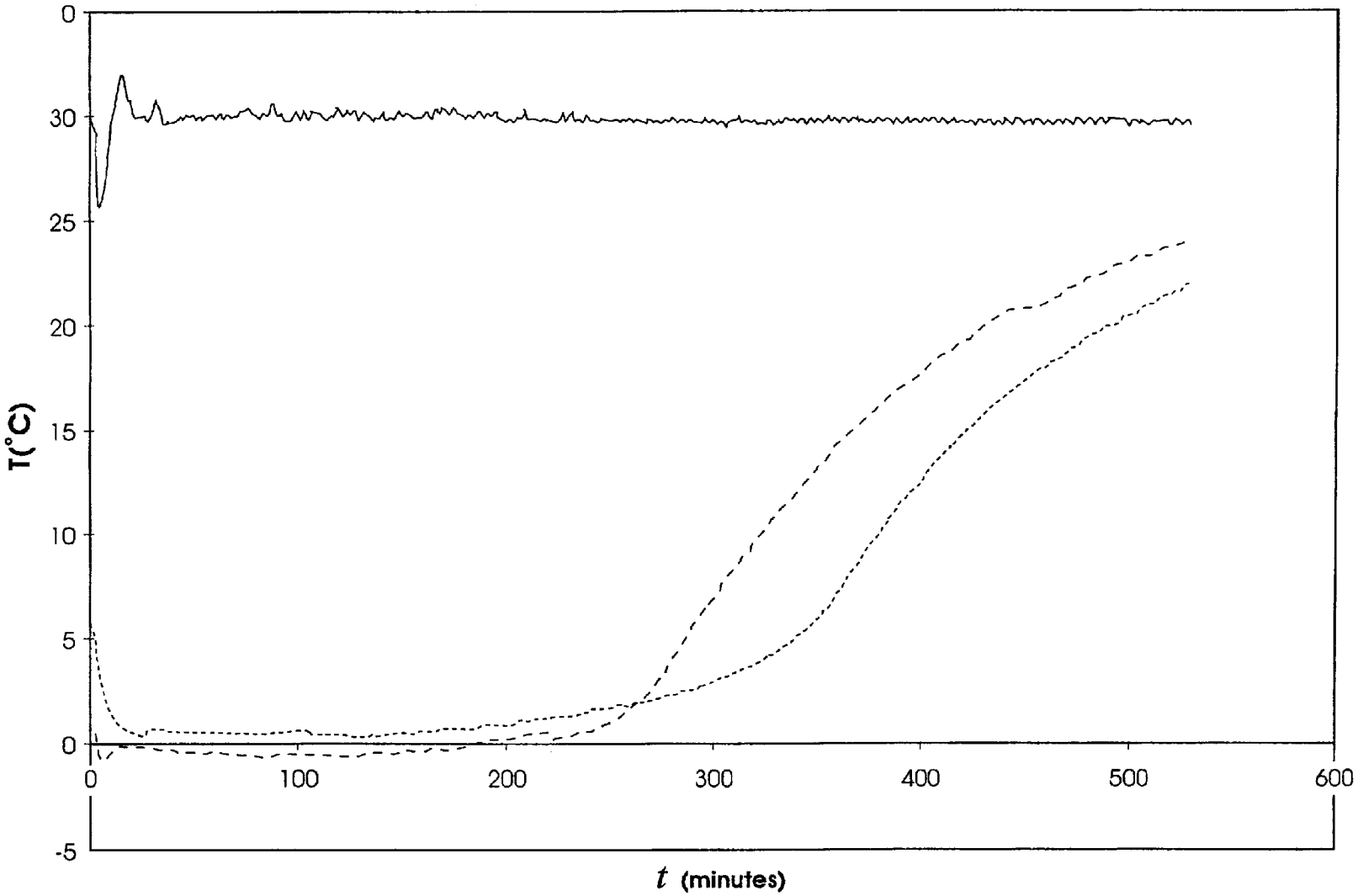
FIG. 11 illustrates temperature measurement in two positions in a container in accordance with the invention.

FIG. 11 demonstrates the differences in temperature between the inside of inner separating layer 6 and the temperature in the cold keeping envelope (a). It can be seen that the temperature in the cold keeping envelope dips below zero whereas in the inside inner separating envelope the temperature remains above zero.

Figure 12:
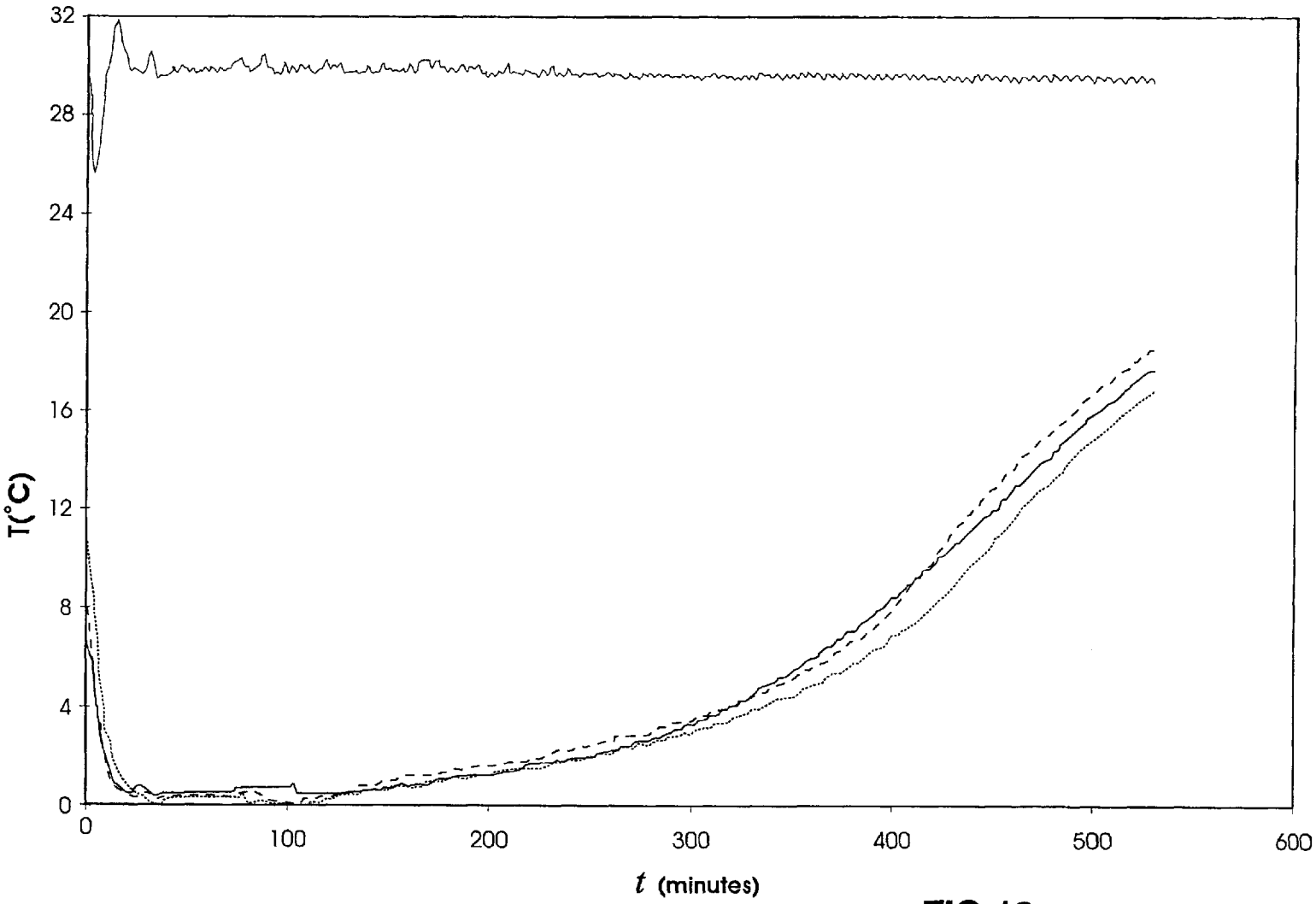
FIG. 12 illustrates three separate test situations in accordance with the invention.

In a precise example described in FIG. 12, three cool keeping bags were constructed along the lines as described previously, each with 400 grams of gel on each internal surface. These were each frozen to a temperature of −22 degrees Centigrade. Water samples (0.5 ml in 5 ml sample vials) were equipped with temperature probes, placed in small cardboard boxes just big enough to contain the vials and then placed in the envelopes as also previously described at 1. These bags were designed to fit snugly within the cool keeping bags and were double walled polythene bags with absorbent paper acting within the walls.

The paper packaging which is fibrous in nature were saturated with water in the manner previously described. Each envelope measured 185×260 mm and contained 355 mm of water in the absorbent paper. The bags were kept in a refrigerator prior to use at a temperature that was approximately that of the sample to be used and were accordingly not frozen. The cool keeping bags were then studied in a constant temperature facility kept at 30 degrees Centigrade.

The results are the three graphs as set out in FIG. 12, the variation in each of the graphs being natural experimental variation and all three would appear to have illustrated very well the principle involved. None of the temperature probes registered a temperature of less than 0.3 degrees Centigrade and the samples therefore were able to be determined not to have frozen.

From the above, it will now be appreciated that we have provided a very significant advance in the area which enables people to extend significantly the time that important medicines can be kept at an appropriate temperature by means which are relatively simple to use and to keep and which do not involve separate refrigeration devices.

Accordingly, commercial transport, for instance, between a pharmaceutical supplier and user, can now be achieved within a much larger range of times and with less concern about ambient temperatures for that period.

Variations are possible, in terms of the arrangements described, but the purpose of the illustrations and description are for illustration purposes and not for limitation purposes at all.

What is claimed is:

1. A storage container for storage of temperature sensitive materials during transport, the storage container being characterized in that it includes:

an outer layer or container of coolant material able to be frozen to temperatures substantially below the freezing point of water; and a removable inner separating layer configured to separate the material to be stored and transported from the outer layer or container, the inner separating layer containing a volume of water therein, the volume of water being determined in proportion to the amount of coolant material in the outer layer.

2. A storage container according to claim 1, further characterized in that the relative proportions of water in the outer layer or container and the inner separating layer are selected such that during typical transport times the temperature of material held in the container is maintained within the temperature range 0–8° C.

3. A storage container according to claim 2 characterized in that the coolant material in the outer layer or container is water.

4. A storage container according to claim 1 characterized in that the coolant material in the outer layer or container is water.

5. A storage container according to claim 4, characterized in that there are at least 18 g of water in the inner separating layer for each 100 g of water in the outer layer or container.

6. A storage container according to claim 1 characterized in that the separating layer consists of an envelope having a double wall of flexible sheet material having water contained there between.

7. A storage container according to claim 6 characterized in that the water is maintained in a gel.

8. A storage container according to claim 7 characterized in that the gel is a polyethylene glycol/water gel or a mixture of cross-linked sodium polyacrylate superabsorbent and water.

9. A storage container according to claim 5 characterized in that the inner separating layer contains a water gel held in a fibrous matting layer.

10. A storage container according to claim 1 characterized in that the water in the separating layer is contained within pockets in the separating layer.

11. A storage container according to claim 1 characterized in that the outer layer consists of an envelope of flexible sheet material having a freezable liquid on one or more sides thereof.

12. A storage container according to claim 11, characterized in that the outer layer envelope has an outer reflective surface.

13. A storage container according to claim 11, characterized in that the outer layer envelope includes a layer of cell like material between an outer surface and the freezable liquid.

14. A storage container for storage of materials that are to be kept cold but not to be frozen over an extended period of time, the storage container comprising:

a container containing a liquid coolant material having a freezing temperature which is substantially below the freezing temperature of water; and a removable inner member configured to separate material to be stored and transported from the outer layer to container, the inner member containing a volume of water therein, the volume of water being selected so as to offset freezing temperatures provided by to the coolant material.

15. A method of transport of materials that are to be kept cold but not to be frozen over an extended period of time, the method comprising:

placing such material in a storage container as in claim 1 further characterized in that the liquid coolant material is in a frozen state and the water is not frozen.

* * * * *